US006981811B2

(12) United States Patent
Breidenbach et al.

(10) Patent No.: US 6,981,811 B2
(45) Date of Patent: Jan. 3, 2006

(54) LIP PRODUCT APPLICATOR

(76) Inventors: Diane C. Breidenbach, 53 S. Pond La., Smithtown, NY (US) 11787; Laurence W. Mille, 53 S. Pond La., Smithtown, NY (US) 11787

( * ) Notice: Subject to any disclaimer, the term of this patent is extended or adjusted under 35 U.S.C. 154(b) by 0 days.

(21) Appl. No.: 10/607,725

(22) Filed: Jun. 27, 2003

(65) Prior Publication Data

US 2004/0161292 A1 Aug. 19, 2004

Related U.S. Application Data

(63) Continuation of application No. 09/934,076, filed on Aug. 21, 2001, now Pat. No. 6,607,323.

(51) Int. Cl.

| | |
|---|---|
| ***A45D 40/06*** | (2006.01) |
| ***A45D 40/24*** | (2006.01) |
| ***A45D 33/28*** | (2006.01) |
| ***A45D 34/06*** | (2006.01) |

(52) U.S. Cl. ..... 401/6; 401/11; 401/17; 401/18; 401/26; 401/52; 401/75; 401/82; 401/98; 401/172; 401/174; 401/175; 401/179; 401/192; 401/195; 401/262; 401/265

(58) Field of Classification Search ..... 401/6, 401/11, 17, 18, 26, 52, 75, 82, 98, 179, 192, 401/195, 262, 265, 172, 174, 175
See application file for complete search history.

(56) References Cited

U.S. PATENT DOCUMENTS

| | | | | |
|---|---|---|---|---|
| 4,887,924 A | * | 12/1989 | Green | 401/262 X |
| 5,842,802 A | * | 12/1998 | Lang et al. | 401/192 X |
| 5,879,095 A | * | 3/1999 | Gueret | 401/172 |
| 6,607,323 B2 | * | 8/2003 | Breidenbach et al. | 401/6 |

* cited by examiner

*Primary Examiner*—Tuan Nguyen
(74) *Attorney, Agent, or Firm*—Thomas A. O'Rourke; Bodner & O'Rourke

(57) ABSTRACT

An improved lip product applicator for applying a pasty or semi soft lip product to a user's lips comprising a body is described. The body has a product reservoir extending therefrom. The product reservoir is generally hollow and has a tip extending from an end of the reservoir opposite the body. The reservoir has a means for discharging product contained therein through an orifice in said tip. The tip is made of a clear material that permits the user to view the color of the product contained therein. The tip is also tapered and retains its tapered shape as lip product is applied to a user's lips.

33 Claims, 6 Drawing Sheets

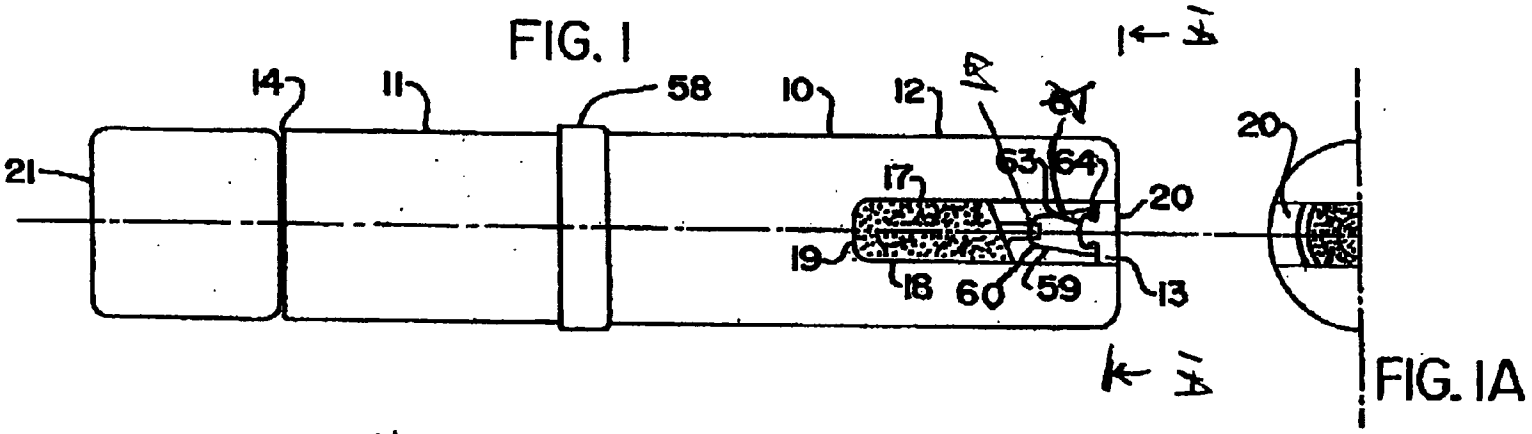
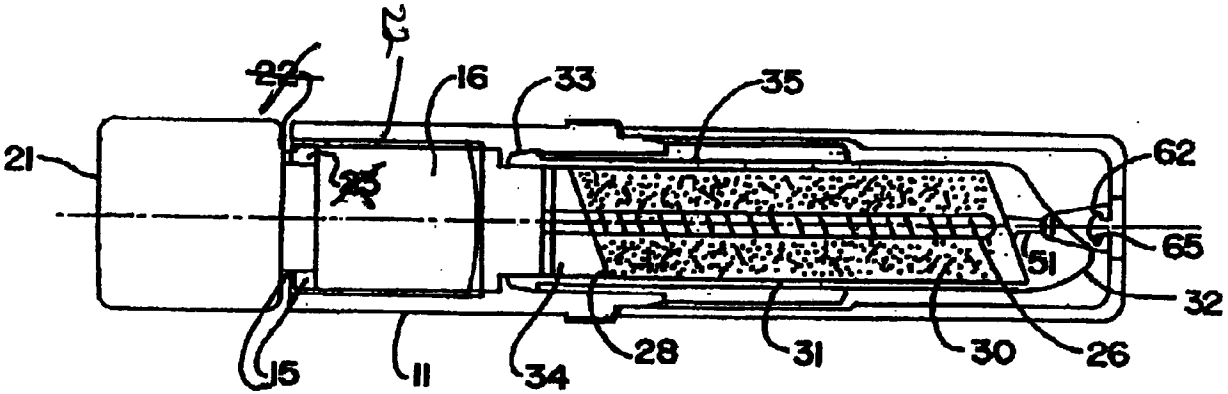
FIG. 2

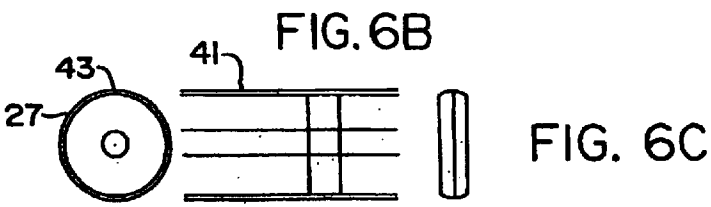
FIG. 6A
FIG. 6B
FIG. 6C
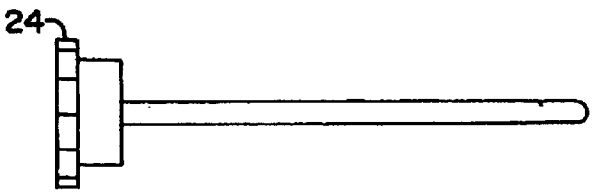
FIG. 7B
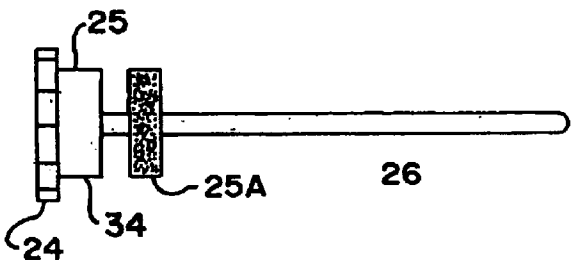
FIG. 7C
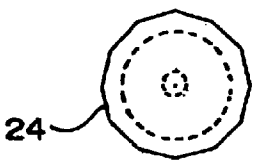
FIG. 7A 74
76
73
37
35
75
50
52
51
32
31
30
33

LIP PRODUCT APPLICATOR

This application is a continuation of U.S. application Ser. No. 09/934,076, filed Aug. 21, 2001, now U.S. Pat. No. 6,607,323, the disclosure of which is incorporated herein by reference.

FIELD OF THE INVENTION

The present invention is directed to improvements in applicators for applying lip products to the lips including lip stick or pomade type applicators.

BACKGROUND OF THE INVENTION

There are many lip cosmetic and other lip products on the market. These may include, for example, lip gloss, lip sticks, lip balm and others. While some lip products may be applied by a finger or a brush from a container, many more are dispensed through the use of a lip applicator. Lip sticks are usually applied through the use of a lip applicator that has a receptacle for the stick of a lip product. The receptacle is usually a recessed member designed to hold a portion of one end of the lip stick. The remainder of the stick extends from the receptacle. The receptacle reposes in a mechanism for extending and retracting the lip stick from the applicator as product is to be used or to store the delicate stick when it is not being applied. There is also a cover over the applicator for further protecting the stick. In some instances the cover may be made of a clear material to permit the purchaser to be able to view the color of the stick.

One of the problems with lip sticks is that the stick can easily be damaged or break off if the proper care is not taken. Another problem with lip sticks arises when the user fails to return the stick to a recessed position after use. In these situations, the stick can become smudged, smashed or lose its shape if the cap is placed on the extended lip stick. When a lip stick is initially purchased, the stick is pre-shaped to a point or the stick is angled to permit the user to apply the lip stick in the desired manner. As time goes on, however, the lip stick, because it is relatively soft, has a tendency to lose the crisp point or angle it arrived with. As a result, it becomes more difficult for the user to obtain the clean lines that are usually sought. One effect of such abrasion is that the user either disposes of the product before it is completely used or attempts to reshape the tip.

Another issue with respect to lip sticks or pomades relates to color selection. Many consumers are very particular in selecting the color of their lipstick. Color is important for a number of reasons. One important factor in color selection is each person's individual tastes. People have preferences for certain colors over others. One person may like one color more than another. A person may think that one color looks better than another on them. Skin coloring can also enter into the equation. One color may look better with one person's skin tone but not another's. Also, a fashion sense also becomes a factor. There are some colors that may be "in" at one point of time but not another.

Cosmetic companies try to inform the consumer of the color that a lipstick may have in a number of ways. One approach is to provide the lipstick applicator with a clear cover that permits the consumer to view the lipstick through the cover. Because lip stick applicators are not only a product dispenser but also can be a fashion accessory, a clear cover is not always desired by the manufacturer or the purchaser for many reasons including aesthetic or styling reasons. Another approach is to use a color sample on the package, on the applicator or elsewhere. While this gives the consumer some color information there are issues with the color card or sample. First, the color is printed on paper. Paper while reproducing the color to a certain extent does not identically match the color in the applicator. The difference caused by the paper can also be exacerbated depending on the type of paper the color is reproduced on. Depending on whether the paper has a matte finish or a glossy finish and what the background color is that the color swatch has around it the eye may perceive a difference between the color on the paper and the actual color of the product in the package. Some manufacturers attempt to avoid this discrepancy by permitting the user to remove the cap and see the actual product contained therein. While this solves the color selection concern there are other sometimes more serious issues caused by this approach. The manufacturer runs the risk that the consumer does more than just view the product and actually samples it by applying it to the lips. For some reason, many consumers after sampling the product in this manner do not purchase the specific item sampled but rather pick an unused one to purchase. Permitting the consumer to have access to the product can raise very serious safety concerns due to the risk of product tampering. Also, when the consumer has access to the product in the store, there is also the possibility that the product can become contaminated from the use. Even apart from these issues, when the product is available in this manner, the consumer is not always careful in replacing the cap, retracting the product into the applicator prior to replacing the cap, etc.

OBJECTS OF THE INVENTION

It is an object of the present invention to provide an improved lip applicator.

It is an object of the present invention to provide an improved lip applicator that has an applicator portion that provides accurate application of lip product to the lips.

It is also an object of the invention to provide a lip applicator in which the applicator portion retains its shape over use.

It is another object of the invention to provide a lip applicator that has a viewing window in the cap to permit the purchaser to view the contents of the product without opening the product.

It is a still further object of the invention to provide a lip applicator that has a unique dispensing system.

It is an object of the invention to provide a lip applicator with a unique tip for applying lip product.

It is a still further object of the present invention to provide an improved applicator surface that permits the lip product to be applied in a smooth manner as if it were a traditional stick of lip product or a pomade.

It is also an object of the invention to provide a lip applicator that permits the consumer to see the quantity of lip product present in the applicator at the time of purchase and during use.

It is another object of the invention to provide an improved lip product applicator that provides more complete removal of the lip product from the dispenser.

SUMMARY OF THE INVENTION

The present invention is directed to an improved lip applicator that has a body and a cap for protecting the lip product in the applicator. The cap may be provided with one or more windows to permit viewing of the color of the lip applicator. If desired, the window may be on one side of the cap, on two opposite sides of the cap or in other areas as desired. For those instances where the window is on both sides of the cap the two window sections may be individual windows or the windows may be joined by a top window portion that extends across the top surface of the cap. The window may be made of any suitable material such as a clear plastic such as a glycol modified polyethylene-terephthalate polymer material (PETG) or other clear material. The applicator of the present invention may be used to dispense lip products or any other products that have a creamy or pasty consistency including but not limited to concealer and eye shadow.

The base of the body may be provided with an opening to receive a top portion of a fragrance container. The fragrance container is secured into the base by a cap member that receives the top of the perfume dispenser and seals the perfume container. Other cosmetic or other containers can be substituted for the perfume container. For example, there may be a bottle of nail polish, face cream, lip gloss, eye shadow, eye liner, powder, cream and others.

The body of the applicator may be a hollow tube, open at both ends. An open end on the bottom of the body conveniently permits insertion of the remainder of the lip applicator into the body as well as permitting filling of the applicator with lip product through that end. An end piece may be applied over the open end when assembly or filling is completed.

A product reservoir is positioned within the body and is preferably a generally hollow member having a round side wall and a tip. At the open end of the reservoir there is positioned a drive means for driving product from the applicator to be applied to the user's lips. The drive means may be a disk that is usually outside of the reservoir and preferably secured within the body of the applicator. Extending from one side of the disk is a support member that extends from the side of the disk that is opposite the base of the body. The support member can either be integral with the disk or a separate member therefrom. If it is a separate member, it should be secured to the disk in some fashion. The support member is inserted into the open end of the reservoir.

The support member provides an anchoring means for the screw means. The screw means is a threaded rod that has one end embedded in or secured to the support member and the other end free within the reservoir. Riding on the screw means is a driving member which is a round disk-like member that has the screw means pass through generally the center thereof. The driving member receives the threads of the screw means and rides upwardly or downwardly on the threads as the body of the applicator is turned. To prevent the driving member from merely turning in response to the motion of the body and not traveling in the reservoir, the interior wall is preferably provided with a guide member that extends from the wall of the reservoir along at least a portion of its length and mates with a recess along the edge of the driving member. The travel of the driving member upwardly forces product within the reservoir to be dispensed.

Adhered to a portion of the circumference of the reservoir is a turning collar or A-shell which is connected to the reservoir by a suitable means and provides an area where the user of the lip product holds the applicator to prevent the reservoir from turning as the body is being turned. The turning collar or A-shell may be provided with a window permitting the purchaser to view the product's color and to also determine the amount of product remaining in the reservoir. The window may be a strip of clear material such as PETG or other clear material.

The reservoir has a tip that is preferably tapered and is provided with a tear drop shaped face. The face is also preferably slightly concave along both the vertical and horizontal axes to permit lip product to be retained on the face when it is discharged from the reservoir. The face is preferably provided with a plurality of canals or channels for receiving lip product. In a preferred embodiment the channels or canals are arranged such that there is perimeter canal that traces the edge of the face, a first vertical canal that extends downwardly from the orifice. The first vertical canal may be crossed by first and second horizontal canals. The perimeter canal keeps applicator clean and prevents lip product from spilling down the sides.

The cap prevents contamination of the product when the applicator is not in use. Where the cap meets the body there may be a skirt or trim ring. The interior of the cap is provided with a plug which is inserted into the orifice in the tip to prevent product from being expelled during storage and to protect the product from contamination when not in use. The plug may be tapered. The plug may also keep the product applicator airtight to prevent damage to the product.

BRIEF DESCRIPTION OF THE DRAWINGS

FIG. 1 is a side view of a representative lip stick applicator of the present invention with a perfume dispenser present.

FIG. 1A is a partial top view of the cap of FIG. 1.

FIG. 2 is a cut away view of the lip stick applicator of FIG. 1.

FIG. 6A is a front view of the driving member.

FIG. 6B is a side view of the wall of the reservoir with a driving member in the reservoir.

FIG. 6C is a side view of the driving member.

FIG. 7A is a front view of the drive means disk.

FIG. 7B is a side view of one embodiment of the drive means.

FIG. 7C is side view of another embodiment of the drive means.

DETAILED DESCRIPTION OF THE INVENTION

Figure 3:
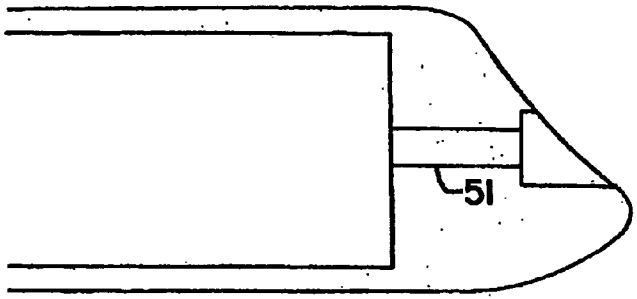
FIG. 3 is a side view of the reservoir and tip.

As seen in FIG. 1 there is a lip applicator 10 that has a body 11, and a cap 12 for protecting the lip product contained in the applicator when the lip applicator is not in use. The cap 12 may be provided with one or more windows 13 to permit the purchaser to view the color of the contents contained therein. This feature helps eliminate the guess work that a consumer must perform to ascertain the color of the lip product in lip applicators that do not have the traditional clear cap. The window may have a first edge 17, a second edge 18 and a base edge 19. If desired, the window may be on one side of the cap, on two opposite sides of the cap or more as desired. For those instances where the window may be on both sides of the cap, the two window sections may be individual windows or the windows may be joined by a top window portion 20 that extends across a portion of the cap. The window may be made of any suitable material such as a clear plastic or other material that permits viewing of the product contained therein. Although the window is shown as generally rectangular it will be appreciated that the window may be round or given any shape desired.

The lip applicator of the present invention may be any shape although traditionally, these applicators are generally long and slender, i.e., have a length greater than their width. The applicator body and cap can have a round cross section, rectangular cross section or any other cross sectional shape desired. In one embodiment, the cross sectional shape may be a polygon such as a hexagon, heptagon or octagon. The body 11 of the applicator may end in a base 14 that is preferably flat to permit the applicator to stand in a vertical orientation.

In one embodiment of the invention, the base 14 of the body may be provided with an opening 15 to receive a top portion of a fragrance container 21 as described more fully in our U.S. patent application Ser. No. 09/842372 filed Apr. 25, 2001, the disclosure of which is incorporated herein by reference. The fragrance container is secured into the base by a cap member 16 that receives the top of the fragrance container and seals the container. In addition, the cap member 16 may be secured to the interior surface of the body 11 by an adhesive, or other means such as threading, a friction fit, etc. The cap member 16 maybe threaded on its interior surface 23 to receive the threaded top of the perfume container. A snap fit and other types of means to secure the container to the cap member may also be used as desired. Although the presence of a perfume container has been described herein, it will be appreciated that other cosmetic or other containers can be substituted for the perfume container shown herein. For example, there may be a bottle of nail polish, face cream, lip gloss, eye shadow, eye liner, powder, cream and others.

The applicator of the present invention is shown in more detail in FIG. 2. The body 11 may be a hollow tube, open at both ends, a cup like member with a base section and sidewalls, etc. The hollow tube arrangement is particularly advantageous where there is a perfume or other container present in one end of the body. Also, a hollow tube is useful even when another container is not present extending from the body. In these instances, an open end on the bottom of the body conveniently permits insertion of the remainder of the lip applicator into the body as well as permitting filling of the applicator with lip product through that end. An end piece 71 may be applied over the open end when assembly or filling is completed. This end piece may be adhered to the body by a suitable adhesive or it may be secured by other conventional means.

Within the body 11 is positioned a product reservoir 30 which is preferably a generally hollow member having a side wall 31 and a tip 32. The reservoir can be a round tubular member or have another shape for the cross section. The tip may be integral with the sidewall or may be a separate member. Where the tip is integral, the reservoir is usually open at the end 33 opposite the tip. This open end can be used to fill the reservoir with a lip product. The lip product is not the typical solid lip product that is usually found in most sticks of lip product but is preferably of a pasty or semi-soft consistency so that it will flow from the applicator upon an application of pressure. At the open end of the reservoir 33 there is positioned a drive means 34 for driving product from the applicator to be applied to the user's lips.

The drive means may be a disk 24 that is usually outside of the reservoir 30 and preferably secured within the body 11 of the applicator. One means of securing the disk in the body is by an adhesive. Another approach is to make the body slightly tapered and the diameter of the disk should be slightly larger than at least a portion of the inner diameter of the body. Although the term diameter is used herein to describe the distance from one inner wall of the body to the other, it will be appreciated that the inner wall need not be circular and the disk similarly need not be circular. As long as the disk can be secured to the body the disk and the body can be any shape. As seen in FIG. 7A the disk 24 has a polygonal perimeter and is not round. It has been found that such a design provides sufficient friction so that the disk is secure in the body. Extending from one side of the disk 24 is a support member 25. The support member 25 extends from the side of the disk that is opposite the base 14 of the body. Support member 25 can either be integral with the disk 24 or a separate member therefrom. If it is a separate member, it should be secured to the disk in some fashion. Support member 25 is inserted into the open end 33 of the reservoir 30. On top of support member 25 there may be a sponge type material 25A to help seal the end of the reservoir but this sponge member is not necessary in most instances.

The support member 25 provides an anchoring means for the screw means 26. The screw means 26 is generally in the center of one side of the support member. As seen in FIG. 7B the screw means 26 is a threaded rod that has one end embedded in or secured to the support member 25 and the other end preferably being free within the reservoir 30. Alternatively, the screw means may be anchored at its end opposite to the support member in the underside of the tip 32. Riding on the screw means 26 is driving member 27. The driving member 27 is preferably a round disk-like member that has the screw means pass through generally the center thereof. Although the driving member may be generally parallel to the base of the body, in one embodiment the driving member may be angled as shown at 28. Where the driving member is angled, the underside of the tip 32 should also be angled to permit the user to remove as much product as possible from the applicator. The driving member 27 receives the threads of the screw means 26 and rides upwardly or downwardly on the threads as the body of the applicator is turned. To prevent the driving member 27 from merely turning in response to the motion of the body 11 and not traveling in the reservoir, the interior wall is preferably provided with a guide member 41 that extends from the wall of the reservoir along at least a portion of its length. The driving member has a recess along its edge 43 for receiving the guide member 41. Alternatively, the driving member 27 may be provided with the guide member and the inside wall surface of the reservoir has a recess for receiving the guide member on the driving member. The travel of the driving member 27 upwardly forces product within the reservoir to be dispensed.

Around the reservoir 30 and generally in the vicinity of the open end 33 may be a turning collar or A-shell 35. Turning collar 35 is between the body 11 and the reservoir 30. In this preferred embodiment, the collar 35 is adhered to a portion of the circumference of the reservoir 30. The collar acts as a finger hold to provide an area where the user of the lip product can place their fingers to prevent the reservoir from turning as the body is being turned to drive the driving member 28 to dispense or retract product. The collar is connected to the reservoir by a suitable means. The collar 35 preferably has one end slightly within the end of the body primarily for aesthetic reasons. The finger hold may preferably be either entirely made of a clear material or the hand hold may be provided with a slit or window 37 permitting the purchaser to view the product's color with the cap removed and to also determine the amount of product remaining in the reservoir. When a slit is present it may extend from the edge of the turning collar 35 and have a pair of side edges 73 and 74 as well as a base portion 75. In another embodiment the slit does not extend to the edge of the collar 72. When a window is present the window preferably does not extend to the edge of the collar and has a top edge 76, side edges 73 and 74 and base portion 75. The window may be a strip of clear material such as PETG or other clear material. As discussed above, the window and or slit is depicted generally rectangularly but any number of shapes are satisfactory as long as the amount of product or the color can be viewed through the window or slit.

Figure 4:
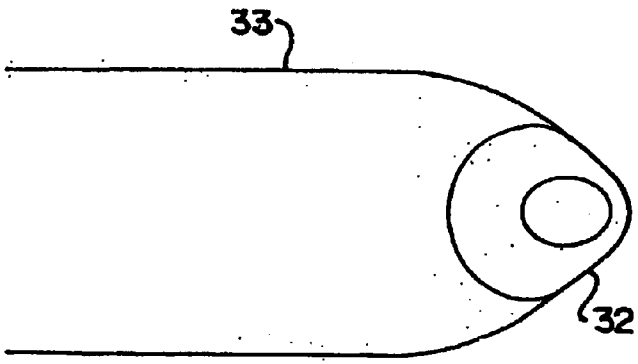
FIG. 4 is a front view of the reservoir and tip showing the face of the applicator.
Figure 5:
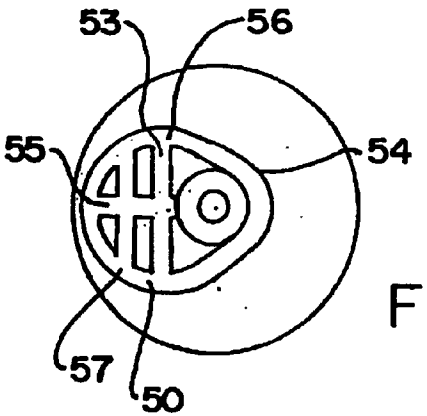
FIG. 5 is a detailed view of the face of the tip.
Figure 8:
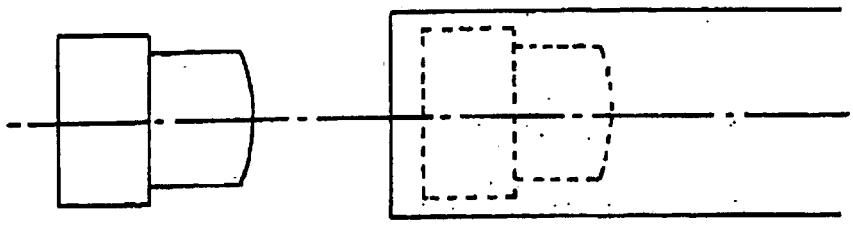
FIGS. 8A and 8B are side views of the cap of a container and the base of the body prior to insertion.
Figure 9:
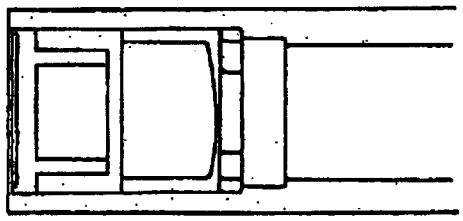
FIG. 9 is a side view of an alternative embodiment where an end piece is present at the base of the body.
Figure 10A:
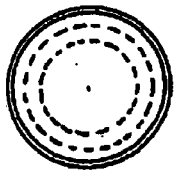
FIG. 10A is an end view of the end piece.
Figure 10B:
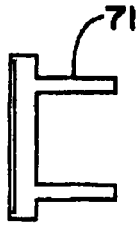
FIG. 10B is a side view of the end piece.
Figure 11A:
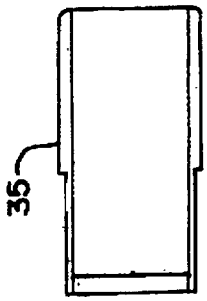
FIG. 11A is a side view of the collar or A-shell of the applicator.
Figure 11D:
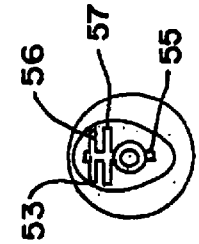
FIG. 11D is an alternative embodiment of the face of the applicator.
Figure 11B:
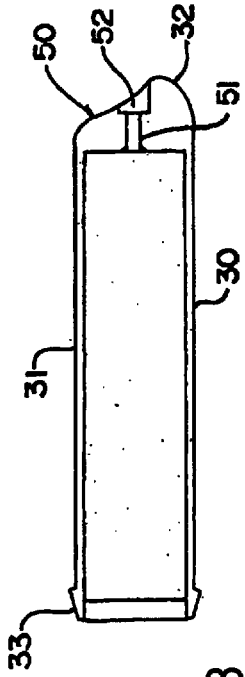
FIG. 11B is a side view of the reservoir for the applicator without the collar.
Figure 11C:
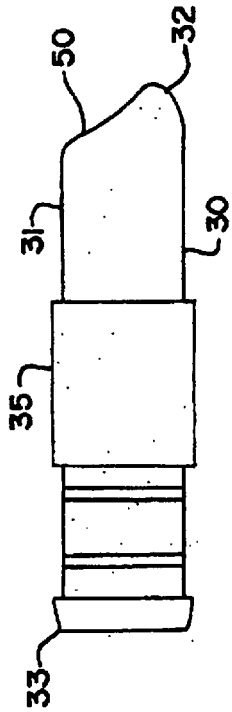
FIG. 11C is a side view of the reservoir of the applicator with the collar in place.
Figures 12A, 12B, 12C:
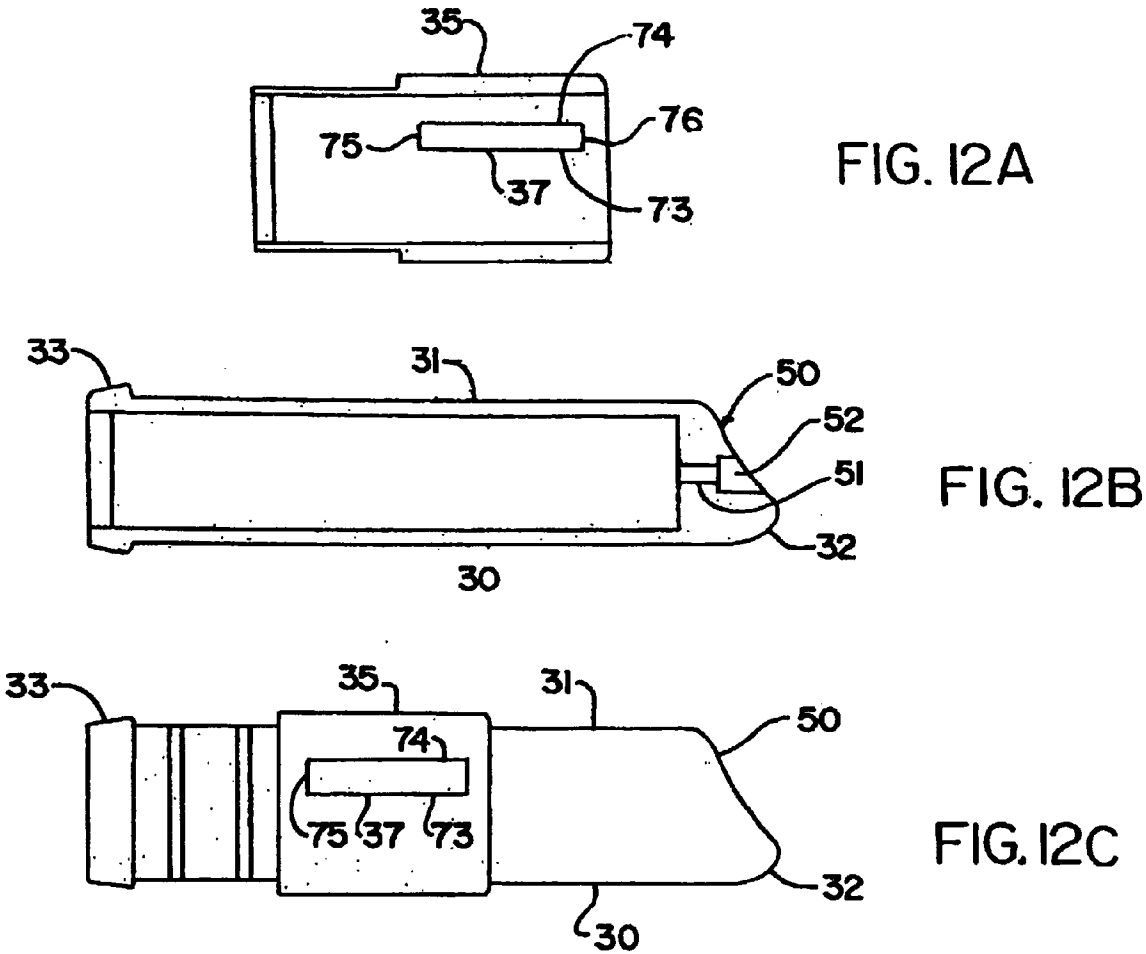
FIG. 12A is a side view of the collar or A-shell of the applicator with a window present.
FIG. 12B is a side view of the reservoir for the applicator without the collar.
FIG. 12C is a side view of the reservoir of the applicator with the collar in place showing the window.

As noted above, the reservoir 30 has a tip 32. This tip is preferably tapered in the manner shown in FIGS. 3 and 4. The tip is provided with a tear drop shape. More specifically, the tip 32 has a face 50 that in addition to the teardrop shape is also preferably slightly concave along both the vertical and horizontal axes to permit lip product to be retained on the face when it is discharged from the reservoir 30 through tube 51 and out of orifice 52. The orifice 52 may be larger in diameter than the tube 51 or the orifice may be angled and then the orifice will appear to be larger due to the angle of the face 50. The face 50 is preferably provided with a plurality of canals or channels 53 for receiving lip product. In a preferred embodiment the canals are arranged such that there is a perimeter canal 54 that traces the edge of the face, a first vertical canal 55 that extends from the orifice 52. The first vertical canal 55 may be bisected by first and second horizontal canals 56 and 57. An alternative embodiment of the face is shown in FIG. 11D. Although it has been found that the arrangement of the canals permits the user to apply lip product in a manner similar to the traditional lip stick there are other arrangements that may be used. One of the advantages of the present invention is that the applicator tip maintains its shape and provides an angle far applying the lip product that is similar to the angle of the traditional lip stick without wearing away from use or having its shape distorted. In a preferred embodiment, the tip of the lip applicator is clear or translucent so that the color of the product shows through it. In another embodiment, the tip maybe colored to mask the color of the lip material.

The cap 12 fits over the applicator tip to prevent contamination of the product when the applicator is not in use. Where the cap 12 meets the body 11 there is provided a skirt 58 which aids in disguising any minor differences in the size of the cap compared to the size of the body. The interior of the cap is provided with plug 59 which is inserted into the orifice 52 to prevent product from being expelled during storage and to protect the product from contamination when not in use. In a preferred embodiment, the plug 59 is tapered, i.e., is narrower at the tip 60 than it is at its base 61. The base 61 of the plug 59 is secured to the cap by any convenient means. One preferred means that is particularly suitable where the window in the cap extends over the top portion of the cap is to provide the interior surface of the cap with a protruding member 62 having a head 63 that is larger than its stem 64. This head is inserted in a recess 65 in plug 59 and secures the plug to the cap.

What is claimed is:

1. An improved lip product applicator for applying a pasty or semi soft lip product to a user's lips comprising a body, said body having extending therefrom a product reservoir, said product reservoir being hollow and having a tip extending from an end of said reservoir opposite said body, said reservoir having a means for discharging said product contained therein through an orifice in said tip, said tip having a tapered applicator surface and said tip retaining said tapered shape as said lip product is applied to the user's lips, said reservoir having a top wall, a bottom wall and a side wall, said orifice connecting said tip to said top wall, said reservoir having therein a disk having a generally flat product contact surface capable of traveling through the reservoir forcing the product through said orifice as said disk travels through said reservoir, said reservoir being configured such that said top wall of said reservoir is generally sloped in the same direction as the product contact surface of the disk and the tapered applicator surface of the tip.

2. The lip applicator according to claim 1 further comprising a cap, said cap having a top surface and a sidewall extending from said top surface, said sidewall being provided with one or more windows in said a sidewall to permit viewing of the color of the lip product in the applicator.

3. The lip applicator according to claim 2 wherein there are windows on both sides of the cap that are joined by a top window portion that extends across a top surface of the cap.

4. The lip applicator according to claim 2 wherein said window is made of PETG.

5. The lip applicator according to claim 2 wherein said cap has a plug which is inserted into the orifice in the tip when the cap is in place.

6. The lip applicator according to claim 5 wherein said plug is adhered to said cap by means of a protrusion that extends from an inside surface of said cap, said protrusion having a base adjacent to said cap said protrusion being wider at its tip than at its base and said tip mating with the side of the plug opposite said orifice.

7. The lip applicator according to claim 1 wherein said body has an opening to receive a top portion of a container containing another product.

8. The lip applicator according to claim 7 wherein said product is a fragrance.

9. The lip applicator according to claim 7 wherein said product is a nail polish.

10. The lip applicator according to claim 7 wherein said product is a face cream.

11. The lip applicator according to claim 7 wherein said product is a lip gloss.

12. The lip applicator according to claim 7 wherein said product is an eye shadow.

13. The lip applicator according to claim 7 wherein said product is an eye liner.

14. The lip applicator according to claim 7 wherein said product is a powder.

15. The lip applicator according to claim 7 wherein said product is a cream.

16. The lip applicator according to claim 1 wherein said product reservoir has a round side wall.

17. The lip applicator according to claim 16 wherein said product reservoir has a drive means for driving the product from the reservoir.

18. The lip applicator according to claim 17 wherein the drive means is a disk outside of the reservoir and secured within the body of the applicator, said disk supporting a screw means, said screw means having a driving member which rides upwardly or downwardly on the threads as the body of the applicator is turned.

19. The lip applicator according to claim 18 wherein the driving member is prevented from turning by a guide member.

20. The lip applicator according to claim 19 wherein the guide member extends from an interior wall of the reservoir along at least a portion of its length and mates with a recess on the driving member.

21. The lip applicator according to claim 1 wherein there is a collar adhered to a portion of the circumference of the reservoir that provides an area where the user of the lip applicator can hold the applicator to prevent the reservoir from turning as the body is being turned and wherein the hand hold has a window permitting the purchaser to view the product's color and determine the amount of the product remaining in the reservoir.

22. A lip applicator according to claim 1 wherein said tip has a tear drop shaped surface for applying the lip product to the user's lips.

23. The lip applicator according to claim 22 wherein the surface is slightly concave along both a vertical and a horizontal axes to permit the lip product to be retained on the surface when it is discharged from the reservoir.

24. The lip applicator according to claim 23 wherein the surface is provided with a plurality of canals for receiving the lip product.

25. The lip applicator according to claim 24 wherein there is perimeter canal around the perimeter of said concave surface.

26. The lip applicator according to claim 25 wherein there is a first vertical canal that extends downwardly from said orifice to said perimeter canal.

27. The lip applicator according to claim 25 wherein said tip has at least one horizontal canal on said surface extending from said perimeter canal.

28. The applicator according to claim 27 wherein there is a first horizontal canal and a second horizontal canal each horizontal canal extending from one side of the perimeter canal to the opposite side of said perimeter canal and crossing said vertical canal.

29. The lip applicator according to claim 1 wherein said tip is made of a clear material that permits the user to view the color of the product contained therein.

30. The improved lip product applicator according to claim 1 wherein said reservoir has a collar around at least a portion thereof, said collar being comprised of a material permitting a user to view the amount of product remaining in said reservoir.

31. The improved lip product applicator according to claim 30 wherein said collar is made from a clear material.

32. An improved lip product applicator for applying a pasty or semi soft lip product to a user's lips comprising a body, said body having extending therefrom a product reservoir, said product reservoir being hollow and having a tip extending from an end of said reservoir opposite said body, said reservoir having a means for discharging said product contained therein through an orifice in said tip, said tip having a tapered applicator surface and said tip retaining said tapered shape as said lip product is applied to the user's lips, said reservoir having a collar around at least a portion thereof, said collar being comprised of a material permitting a user to view the product in said reservoir.

33. The improved lip product applicator according to claim 32 wherein said collar is made from a clear material.

* * * * *